United States Patent [19]

Ives

[11] 4,454,675

[45] Jun. 19, 1984

[54] LOCKING QUICK-DETACHABLE SLING SWIVEL

[75] Inventor: Robert K. Ives, Portland, Oreg.

[73] Assignee: Michaels of Oregon Co., Portland, Oreg.

[21] Appl. No.: 367,101

[22] Filed: Apr. 9, 1982

[51] Int. Cl.[3] ..... F41C 23/02

[52] U.S. Cl. ..... 42/85

[58] Field of Search ..... 42/85; 224/150

[56] References Cited

U.S. PATENT DOCUMENTS 3,704,537 12/1972 McKinzie ..... 42/85

4,209,157 6/1980 Edmisten ..... 42/85

FOREIGN PATENT DOCUMENTS 1138193 10/1962 Fed. Rep. of Germany ..... 42/85

*Primary Examiner*—Charles T. Jordan

*Attorney, Agent, or Firm*—Chernoff, Vilhauer, McClung, Birdwell & Stenzel

[57] ABSTRACT

A locking, quick-detachable-type firearm sling swivel having a gate which is shiftable, under the influence of a spring-biased plunger, between open and closed positions to enable mounting, demounting and securing of the swivel on a mounting base. Provided for locking the plunger positively and selectively against manipulation to effect opening of the gate is a position-changeable locking element mounted on the plunger for adjustment into and out of effective reactive engagement with the swivel's body. The locking element is captured on the plunger to prevent its inadvertent removal.

14 Claims, 12 Drawing Figures

LOCKING QUICK-DETACHABLE SLING SWIVEL

BACKGROUND AND SUMMARY OF THE INVENTION

This invention relates to a firearm sling swivel of the quick-detachable variety, and more particularly, to such a swivel which can be locked positively and selectively in a condition preventing its accidental release from the usual mounting base.

A popular quick-detachable-type sling swivel has been sold widely for years by Michaels of Oregon Co., Portland, OR. This swivel has a body that carries a mounting pin which, during mounting of the swivel, is inserted in a bore provided in one of a variety of conventional mounting bases attached to a firearm. Carried on the body, and cooperating with this mounting pin, is a shift/swing gate which is manipulatable, through pressing on an elongated spring-biased plunger, to shift between open and closed positions relative to the mounting pin to enable mounting, demounting and general securing of the swivel on a base.

A problem, however, is sometimes encountered when, for some reason, a sudden or at least unexpected lateral tug is exerted on a sling attached to such a swivel, which causes the gate, from its closed position, to separate from and expose the mounting pin, thereby ultimately causing the swivel to demount voluntarily from its associated mounting base.

A general object of the present invention is to provide a unique sling swivel, of the type generally outlined above, which is improved in the sense that it includes a mechanism enabling selective locking of the plunger in the swivel to prevent a demounting accident of the type just described.

Another object of the invention is to provide such a modified swivel, wherein functions other than selective locking are otherwise unchanged, with respect to prior art swivels of the type discussed earlier, so as to provide a swivel product which carries with it all of the good-reputation features associated in the past with the prior swivel type of which it is a modification.

Still a further object of the invention is to provide a locking quick-detachable-type sling swivel, as indicated, which is extremely simple in construction and reliable in performance.

According to a preferred embodiment of the invention, positive, selective plunger locking is effected through the use of a position-changeable locking element which is mounted on the plunger for adjustment into and out of conditions of effective reactive engagement with the body in the swivel. Associated with this locking element is a capture device which, while permitting free operational movement of the locking element, inhibits removal of the element, and hence loss thereof.

According to several embodiments of the invention, the proposed locking element takes the form of an axially shiftable sleeve which is mounted on the usual projecting free end of a plunger. With these types of embodiments, capturing of the sleeve on the plunger is accomplished through the provision either of an abutment-type interference, such as an interacting shoulder and enlargement, or of a non-threaded land in a structure where threaded engagement is provided between the plunger and element.

In another type of embodiment, the locking element takes the form of a spring-biased finger disposed in a longitudinal groove formed on the outside of the plunger's free end. The finger itself has a free end which points toward the body in the swivel to prevent depression of the plunger (against its biasing spring) in the absence of simultaneous depression of the free end of the finger to place it within the clearance groove provided on the side of the plunger.

Various objects and advantages, other than those set forth above, will become apparent as the description which now follows is read in conjunction with the accompanying drawings.

DETAILED DESCRIPTIONS OF EMBODIMENTS OF THE INVENTION

Figure 1:
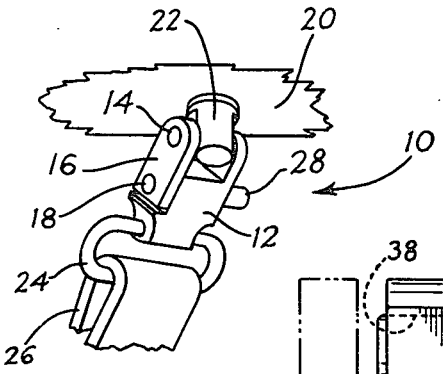
FIG. 1 is a fragmentary, bottom perspective view illustrating a swivel manufactured in accordance with the present invention, mounted on the underside of a firearm stock, and shown carrying a sling.

Turning now to the drawings, and referring first to FIG. 1, indicated generally at 10 is one embodiment of a locking quick-detachable-type swivel constructed in accordance with the present invention. In general terms, swivel 10 includes a body 12 which carries a mounting pin 14 that coacts with a shift/swing gate 16. Gate 16 is joined to the left end (in FIG. 1) of a spring-biased plunger 18. In FIG. 1, swivel 10 is shown mounted in a locked condition on the underside of a firearm stock 20 through a conventional mounting base 22 which is screwed into the stock, and which includes a suitable bore that receives mounting pin 14. On the underside of body 12 there is provided a sling loop 24 which is shown receiving the reverse bend in an end of a sling 26. Indicated at 28 in FIG. 1 is a position-changeable sleeve, or locking element, which is axially adjustable, as will be explained, to place the swivel in locked and unlocked conditions.

With the exception of the features in swivel 10 which accommodate selective locking of the swivel, all other parts therein are of substantially conventional shapes and constructions.

Diverting attention now to FIG. 2, the solid-line representations of parts therein depict the swivel in the same locked condition described with reference to FIG. 1.

Here it can be seen that plunger 18 has a stepped-diameter construction, with a smaller-diameter left-end portion 18*a*, and a larger-diameter right-end portion 18*b*. The plunger is slidably received within a clearance bore 30 provided in body 12, and the left-end portion extends through a chamfered bore 32 in the body, and is press-received within a suitable accommodating bore 34 formed in the lower end of gate 16 in FIG. 2. The biasing spring which is provided for the plunger is shown at 36. This spring acts between the shoulder shown where bores 30, 32 join, and the step previously mentioned in plunger 18.

Figure 2:
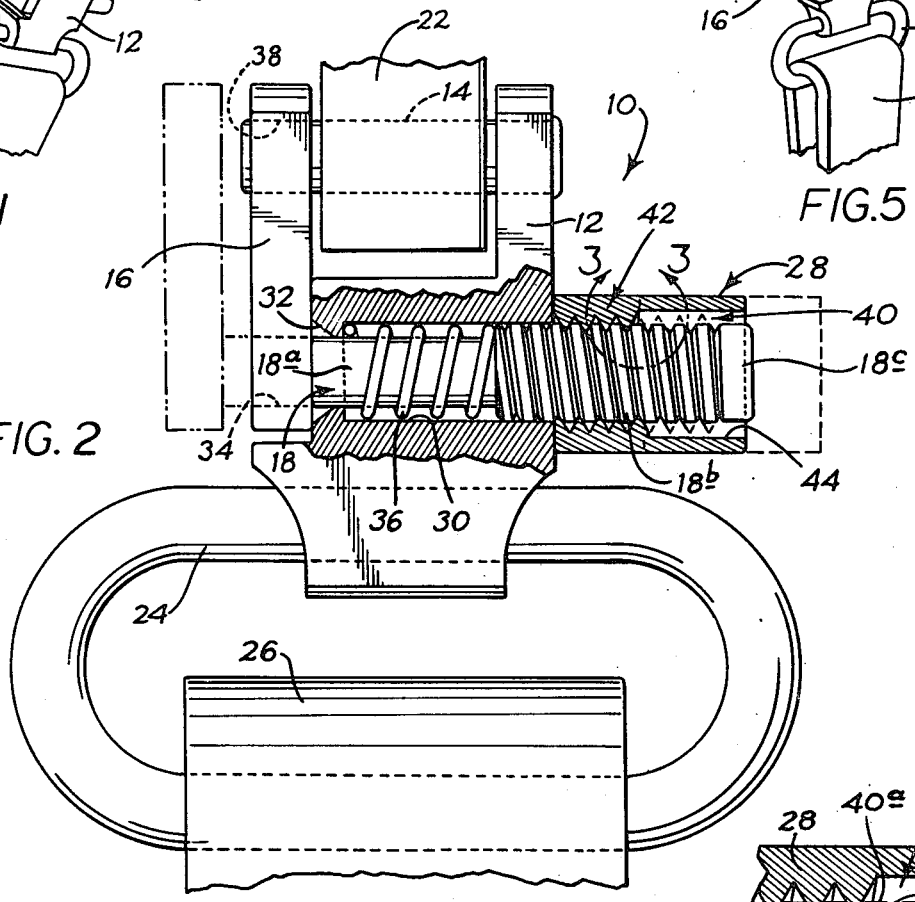
FIG. 2 is an enlarged fragmentary elevation of the swivel shown in FIG. 1, with portions broken away to illustrate details of construction, and with certain movable parts shown in several different relative positions.

In the mounted condition described for swivel 10, the left end of pin 14 in FIG. 2 is freely received within a clearance bore 38 which is provided adjacent the upper end of gate 16 in FIG. 2.

Figure 3:
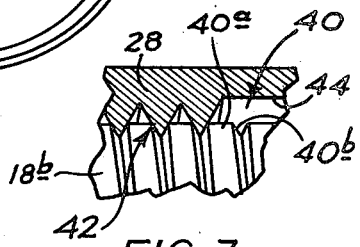
FIG. 3 is an enlarged detail of the area generally encompassed by the curved double-arrow line 3—3 in FIG. 2, which detail shows features of an interactive thread mounting provided between a sleeve and a plunger in the swivel of FIGS. 1 and 2.

Considering now FIG. 3 along with FIG. 2, along a major portion of the length of plunger portion 18*b*, beginning from where the step exists in the plunger, is what is referred to herein as a shallow-root screw thread, shown generally at 40. This thread is characterized by flattened peaks, such as peak 40*a*, which extend between shallow valleys, such as valley 40*b*. Progressing to the right along end portion 18*b* in the plunger, thread 40 terminates short of the right end of the plunger, thus to define what is referred to herein as a non-threaded land 18*c* in the plunger.

Locking sleeve 28 has a hollow cylindrical construction, and is provided internally, adjacent its left end in FIG. 2, with a conventional screw thread, shown at 42, which meshes with thread 40, and a clearance bore 44 adjacent its right end in the figure.

With sleeve 28 screwed onto plunger 18, to the solid-outline position shown for it in FIG. 2 where its left end in the figure abuts the right side of body 12, it will be apparent that axial shifting of the plunger, to move gate 16 into a condition with pin 14 clear of bore 38, is not possible. In this situation, the sleeve is said to be in effective reactive engagement with body 12.

When it is desired to unlock the swivel to permit manipulation of the gate, sleeve 28 is unscrewed relative to the right end of plunger 18 until screw thread 42 runs into land 18*c*, beyond which further unscrewing is impossible. Sleeve 28 is shown in such a position on the plunger in dashed lines in FIG. 2.

With the sleeve in its dashed-line position, axial shifting of the plunger, to the left in FIG. 2 against the action of biasing spring 36, is now possible. With such shifting occurring, gate 16 shift axially to the left in FIG. 2 to a position, such as that indicated in phantom lines, where the upper end of the gate and the left end of pin 14 are free and clear of one another.

Figure 4:
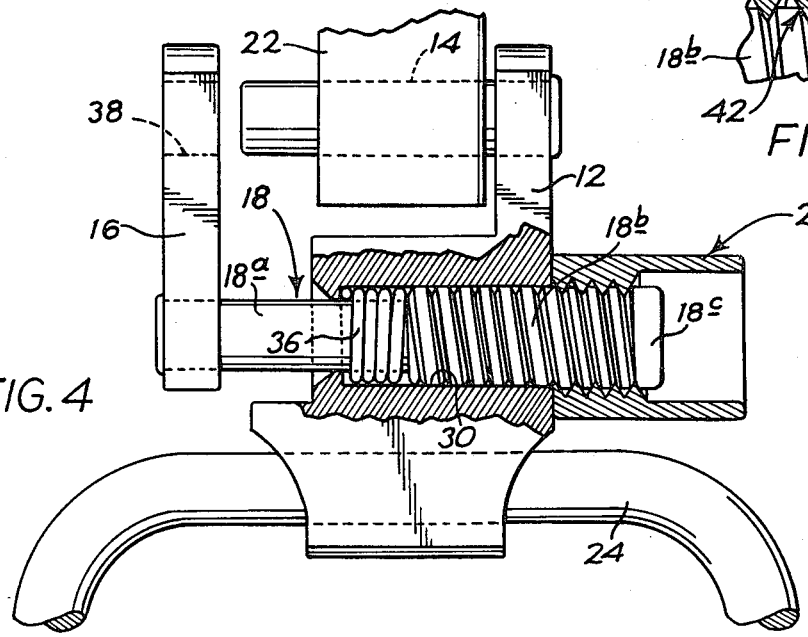
FIG. 4 is a view similar to FIG. 2, again with portions broken away to illustrate interior details, and with movable parts in the swivel shown in solid outline in the same moved positions shown in phantom lines in FIG. 2.

FIG. 4 in the drawings shows in solid lines these relative positions of the parts in swivel 10.

To open the swivel completely to allow demounting of the same from base 22, gate 16 is then swung in a conventional fashion, downwardly and away from the plane of FIG. 4, and the plunger and gate are allowed to be shifted back under the influence of spring 36.

Figure 5:
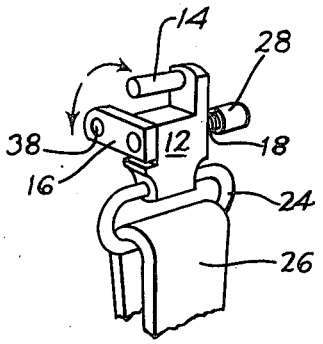
FIG. 5 is somewhat similar to FIG. 1, except that it shows the swivel thereof in a gated-open condition, and removed from the firearm stock.

FIG. 5 generally shows this condition of swivel 10, under circumstances where the swivel has been removed from mounting base 22.

It is thus believed apparent how the swivel illustrated in FIGS. 1–5, inclusive, offers all of the features and advantages referred to herein earlier. Locking and unlocking is acccomplished by the simple action of a screwing sleeve 28 back and forth along the threaded portion of plunger 18 as described. The sleeve is captured, and cannot be lost, inasmuch as it cannot be withdrawn beyond land 18*c*, which thus functions as a capture means for the sleeve.

The shallow-root thread provided in plunger 18 offers several important advantages. To begin with, the flattened peaks in the thread offer a major bearing surface which permits the threaded part of the plunger to slide easily back and forth in bore 30. Further, the shallow valleys in the thread minimize the likelihood of foreign-body accummulation occurring under circumstances with sleeve 28 backed off, and a part of this thread exposed.

Figure 6:
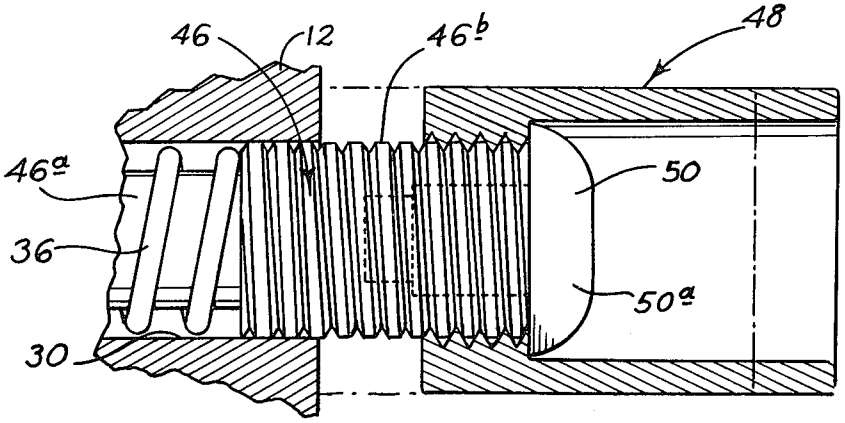
FIGS. 6 and 7 are like central portions of FIG. 2, and show two different locking-swivel modifications which resemble the swivel of FIGS. 1–5, inclusive, in that they each utilize, as a locking element, an axially shiftable sleeve mounted on a plunger.

FIG. 6 shows a modification which differs from that just described, primarily in the means used to capture a sleeve on a plunger. Here, and in the remaining drawing figures, parts which are substantially the same in construction as parts already described are given the same reference numerals.

Thus, there is shown in FIG. 6 a stepped-diameter plunger 46 having an unthreaded left-end portion 46*a* in the figure and a shallow-root threaded right end portion 46*b* in the figure. Screwed onto plunger portion 46*b* is a sleeve 48 which is similar in construction to previously described sleeve 28.

Secured in a suitable accommodating bore provided axially centrally in the right end of plunger 46 is a drive screw 50, having a button-like head 50*a* with an outer diameter which exceeds that of plunger portion 46*b* slightly, as can be seen.

In the swivel modification depicted in FIG. 6, sleeve 48 is captured on plunger 46 through blocking interaction between screw head 50*a* and the shoulder which exists inside the sleeve where the screw threads therein terminate inside the central bore in the sleeve. In solid lines in FIG. 6, the sleeve is shown screwed out all the way on the plunger to place this shoulder and the head in contact. This places the swivel in an unlocked condition which is similar to that described previously for swivel 10.

To lock the swivel, sleeve 48 is screwed onto the plunger to the position shown for it in dash-dot lines in FIG. 6, where the left end of the sleeve in the figure abuts the right side of swivel body 12.

Figure 7:
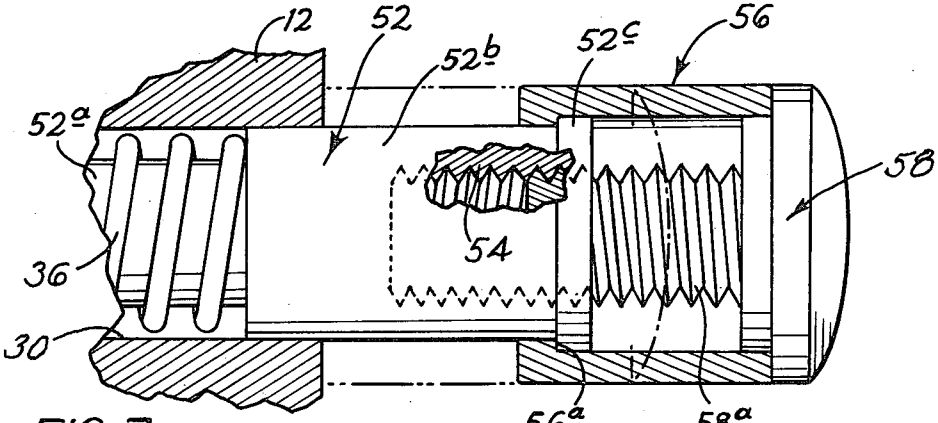

FIG. 7 shows another form of locking swivel in which an axially adjustable sleeve is carried on a plunger to function as a locking and unlocking mechanism.

Here there is shown a stepped-diameter plunger 52 having a smaller-diameter left-end portion 52*a*, and a larger-diameter right-end portion 52*b*. Right-end portion 52*b* is formed with an enlargement 52*c*, and the outside of the plunger in this embodiment is unthreaded. Extending axially centrally into the right end of plunger 52 in FIG. 7 is a threaded bore 54.

Mounted on plunger 52 is a sleeve 56, having, adjacent its left end in FIG. 7, a stepped-internal diameter which defines a shoulder 56*a*. The smaller-internal-diameter left-end portion of sleeve 56 in FIG. 7 is slidably mounted on plunger portion 52*b* as shown, and the sleeve is captured against withdrawal from the plunger because of blocking interference between enlargement 52c and shoulder 56a. Press-fitted into the right end of sleeve 56 in FIG. 7 is a capping device 58, including an axially central threaded pin 58a which is screwed, as can be seen, into bore 54. In FIG. 7, the parts in the swivel modification depicted therein are shown in a condition placing the swivel in an unlocked situation. In this situation, sleeve 56 is unscrewed as far outwardly on the plunger as is possible, such being defined by abutment between enlagement 52c and shoulder 56a. Pin 58a and bore 54 remain threadably engaged. To lock the swivel, the sleeve is screwed inwardly on the plunger until its left end in FIG. 7 contacts the right face of body 12. This situation is shown in dash-dot lines.

Figure 8:
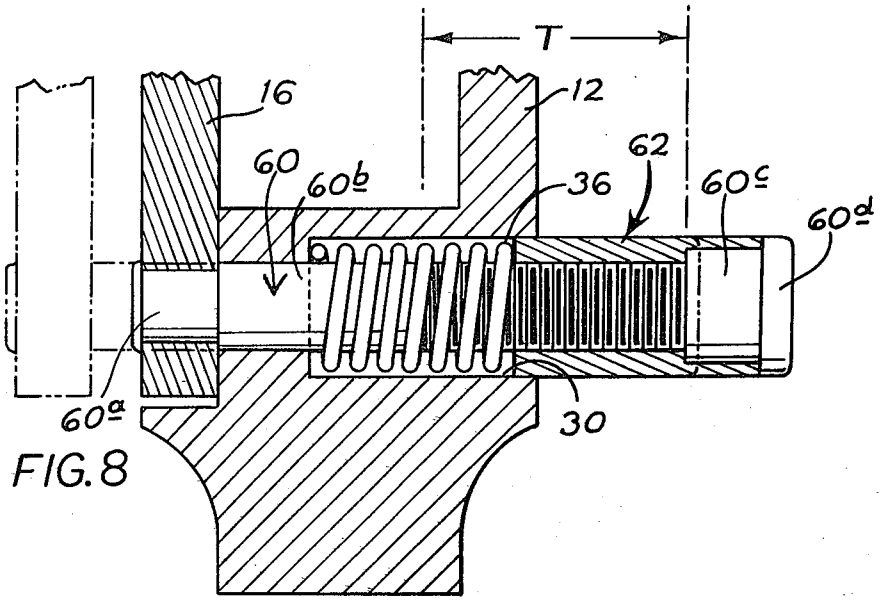
FIGS. 8 and 9 illustrate yet another locking-swivel modification wherein a sleeve-like locking element is employed.
Figure 9:
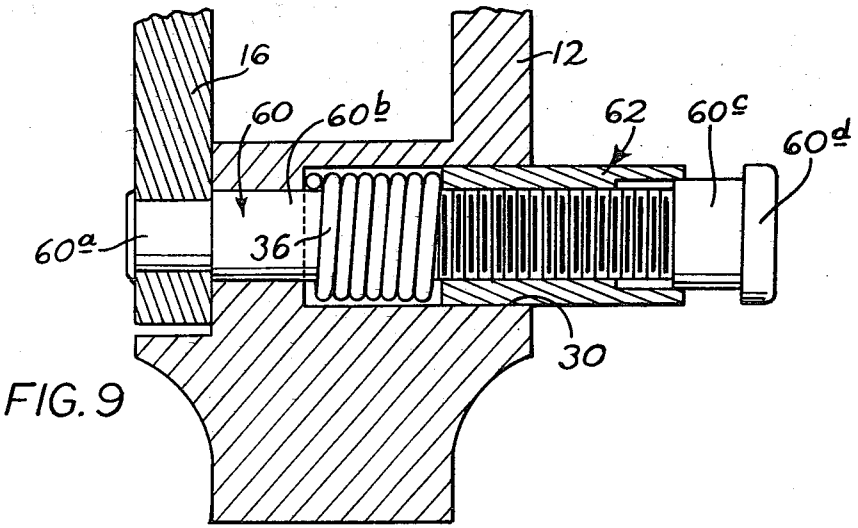

FIGS. 8 and 9 show still a further locking swivel modification in which an axially adjustable sleeve functions as a locking element. Included in the swivel depicted in these two figures is a plunger 60 having a left-end portion 60a joined to gate 16, a left-central portion of slightly greater diameter 60b which is externally threaded along a major portion of its length (shown at T in FIG. 8), a right-central portion of even larger diameter 60c, and a right-end portion 60d, which has a slightly greater outside diameter than portion 60c.

Threadably mounted on portion 60b in the plunger is a sleeve 62 which, adjacent its right end in FIG. 8, has a stepped-internal diameter to accommodate a clearance fit for the right-end portion of the sleeve over plunger portion 60c as shown.

Biasing spring 36 acts between the shoulder depicted in bore 30, and the left end of sleeve 62 in the figures.

With the parts in the relative positions shown in solid lines in FIG. 8, the swivel depicted therein is in an unlocked condition. Pressing to the left on plunger 60 causes sleeve 62 to act against the biasing spring, and to shift inwardly in bore 30 to drive gate 16 outwardly from the left side of body 12 in the figure. Such shifting is possible until spring 36 bottoms out, and when this occurs, the moved parts are as shown in phantom lines in FIG. 8.

To lock the swivel, sleeve 62 is screwed inwardly on the plunger against spring 36, again to cause the spring to bottom out with the sleeve now in a new relative position axially on the plunger. This situation is depicted in FIG. 9. With the sleeve so shifted, and spring 36 so bottomed out, axial shifting of the plunger is inhibited.

Figure 10:
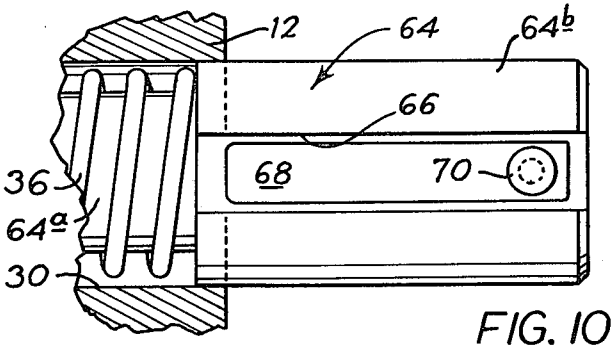
FIGS. 10–12, inclusive, show yet another locking-swivel modification, wherein locking action takes place through the operation of a spring-biased finger mounted on a plunger.
Figure 11:
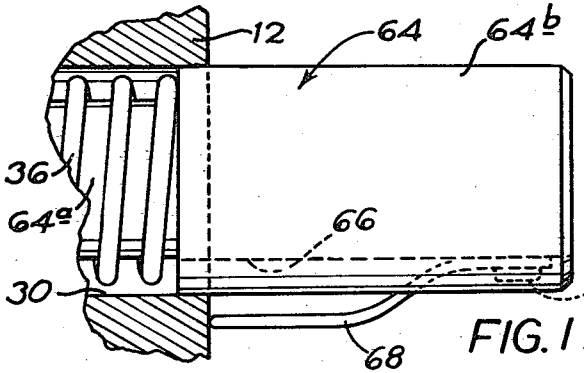
Figure 12:
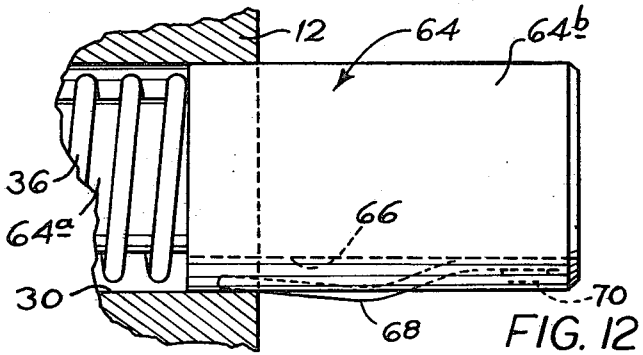

FIGS. 10, 11 and 12 illustrate a further modified form of locking swivel in which the locking element takes the form of a spring-action elongated finger. Referring first of all to FIGS. 10 and 11, included in the swivel depicted in these figures is a stepped-diameter plunger 64 having a smaller-diameter left-end portion 64a in the figures and a larger-diameter right-end portion 64b. Biasing spring 36 acts within bore 30, urging the plunger toward the position shown for it in FIGS. 10 and 11.

Formed on and along one side of plunger portion 64b is a longitudinally extending groove 66. Disposed substantially within, and extending along the majority of the length of, groove 66 is an elongated reversely bent spring action finger 68. The right outer end of finger 68 in FIGS. 10 and 11 is captured within groove 66 by an anchoring pin 70. The left end of finger 68 in FIGS. 10 and 11 is, by virtue of spring action within the finger, biased radially outwardly from groove 66, and confronts the right side of swivel body 12, as shown. This condition—the one illustrated in FIGS. 10 and 11, constitutes the locked condition for the swivel. Interference between the left end of finger 68 and the right side of body 12 prevents depression of plunger 64 against biasing spring 36.

With reference now to FIG. 12, when it is desired to unlock the swivel, this is accomplished simply by pinching the left end of finger 68 to bend it into groove 66, and thereafter depressing the plunger to force it inwardly in bore 30 against spring 36. FIG. 12 shows an early stage of plunger depression.

It should thus now be seen how all of the locking-swivel modifications shown and described herein meet all of the objects and advantages set forth above with respect to reliable swivel locking. And, it sould be apparent that each proposed modification is characterized by a relatively simple and trouble-free construction.

While various embodiments of the invention have been described herein, it is appreciated that other variations may be made without departing from the spirit of the invention.

It is claimed and desired to secure as Letters Patent:

1. In a quick-detachable-type firearm sling swivel having a body, and a shift/swing gate mounted on the body through an elongated spring-biased plunger, which gate, through manipulation of the plunger, is adjustable between open and closed positions relative to the body to enable mounting, demounting and securing of the swivel relative to an external structure, means for locking the plunger positively and selectively against manipulation thereof to open the gate from the latter's closed position, said locking means comprising a position-changeable locking element mounted on the plunger for adjustment relative thereto into and out of conditions of effective reactive engagement with the swivel's body to lock and release the plunger, respectively, against and for manipulation of the gate, and capture means operatively interposed between the plunger and said element inhibiting removal of the element from the plunger.

2. The locking means of claim 1, wherein said locking element takes the form of a generally cylindrical sleeve carried on the plunger for axial adjustment relative thereto.

3. The locking means of claim 2, wherein such axial adjustment is accommodated by a construction including interactive screw threads which are operatively interposed between the plunger and said element.

4. The locking means of claim 3, wherein said capture means comprises an enlargement joined to the plunger, and a shoulder formed within said element, which enlargement and shoulder are engageable to block removal of said element.

5. The locking means of claim 3, wherein said capture means comprises a non-threaded land formed on at least one of said element and plunger.

6. The locking means of claim 3, wherein said screw threads include an outside thread formed on the plunger, and an inside thread formed within said element.

7. The locking means of claim 6, wherein said outside thread is characterized by flattened peaks and shallow valleys.

8. The locking means of claim 6, wherein said capture means comprises an enlargement joined to the plunger, and a shoulder formed within said element, which enlargement and shoulder are engageable to block removal of said element.

9. The locking means of claim 6, wherein said capture means comprises a non-threaded land formed on at least one of said element and plunger.

10. The locking means of claim 6, wherein reactive engagement between said element and the swivel's body takes place through bottoming-out of the biasing spring for the plunger.

11. The locking means of claim 3, wherein said screw threads include an inside thread formed within an axially central bore provided in the plunger, and an outside thread formed on a pin joined to said element and carried axially centrally therewithin.

12. The locking means of claim 11, wherein said capture means comprises an enlargement joined to the plunger, and a shoulder formed within said element, which enlargement and shoulder are engageable to block removal of said element.

13. The locking means of claim 1, wherein the plunger is generally cylindrical, and has a longitudinally extending groove formed in its outside surface, and said locking element comprises an elongated spring-action finger disposed longitudinally within said groove, said finger having an outer fixed end, and an inner free end pointing toward the swivel's body and biased, by spring-action within the finger, radially outwardly toward a position beyond the cross-sectional radius of curvature of the plunger.

14. The locking means of claim 13, wherein said capture means comprises means anchoring said spring's outer end to the plunger.

* * * * *